US008710726B1

(12) United States Patent
Polzin et al.

(10) Patent No.: US 8,710,726 B1
(45) Date of Patent: Apr. 29, 2014

(54) REDUCED PLATING IGNITRON

(75) Inventors: Kurt A Polzin, Owens Cross Roads, AL (US); J Boise Pearson, Madison, AL (US)

(73) Assignee: The United States of America as Represented by the Administrator of the National Aeronautics and Space Administration, Washington, DC (US)

( * ) Notice: Subject to any disclaimer, the term of this patent is extended or adjusted under 35 U.S.C. 154(b) by 168 days.

(21) Appl. No.: 13/523,210

(22) Filed: Jun. 14, 2012

(51) Int. Cl.
*H01J 1/50* (2006.01)
*H05B 31/26* (2006.01)

(52) U.S. Cl.
USPC .. 313/173; 313/171; 315/111.71; 315/111.31

(58) Field of Classification Search
CPC ..... H01J 13/34; H01J 13/50; H01J 13/56; H01J 2893/0087; H01J 37/3244; H01J 37/32458; H01J 37/32532
USPC ..... 315/111.01–111.91, 112, 246, 327, 315/330, 335; 313/29, 163, 170, 171, 313/131 A, 173
See application file for complete search history.

(56) References Cited

U.S. PATENT DOCUMENTS

| | | | | |
|---|---|---|---|---|
| 2,501,308 | A | 3/1950 | Boyer | |
| 2,743,387 | A * | 4/1956 | Lewin et al. | 313/170 |
| 2,946,914 | A * | 7/1960 | Colgate et al. | 376/121 |
| 3,462,573 | A | 8/1969 | Rabinowitz et al. | |
| 3,592,986 | A | 7/1971 | Fox | |
| 3,842,225 | A | 10/1974 | Leeds | |
| 3,891,813 | A | 6/1975 | Yoon et al. | |
| 3,975,651 | A * | 8/1976 | Griffiths | 310/11 |
| 4,060,748 | A * | 11/1977 | Bayless | 313/171 |
| 4,833,363 | A * | 5/1989 | Jennis | 313/173 |
| 4,970,440 | A * | 11/1990 | Eckhardt et al. | 315/327 |
| 5,478,978 | A | 12/1995 | Taylor et al. | |
| 5,792,236 | A | 8/1998 | Taylor et al. | |
| 6,706,980 | B1 | 3/2004 | Narasimhan | |
| 7,189,934 | B2 | 3/2007 | Youngner | |
| 7,990,241 | B2 | 8/2011 | Hernandez et al. | |

OTHER PUBLICATIONS

Diana L. Loree, et al, Recent Advances in High-Power Ignition Development, IEEE Transactions on Electron Devices, Apr. 1991, pp. 720-725, vol. 38, No. 4, IEEE Log No. 9042509.

M.M. Morack and H.C. Steiner, Sealed Tube Ignition Rectifiers, Transactions of the American Institute of Electrical Engineers, Aug. 1942, pp. 594-598, vol. 61.

J.L. Boyer and C.G. Hagensick, High Voltage Ignitron Rectifiers and Inverters for Railroad Service, Transactions of the American Institute of Electrical Engineers, Jul. 1946, pp. 463-470, vol. 65.

John Edward Burke, Plasma Diagnostics on High Current Ignitrons—A Thesis in Electrical Engineering, Accepted Aug. 1989, pp. ii-79, submitted to Graduate Faculty of Texas Tech University for Master of Science in Electrical Engineering.

* cited by examiner

*Primary Examiner* — Vibol Tan
(74) *Attorney, Agent, or Firm* — Absolute Technology Law Group LLC; James J. McGroary

(57) ABSTRACT

An ignitron apparatus has an airtight tubular housing having a first sealed end and a second sealed end. An anode is connected at the first sealed end, projecting into the housing, and a recess at the second sealed and forms a well which contains a quantity of liquid gallium or gallium alloy making up the cathode. An ignitor projects through the liquid metal and into the housing. The inner surface of the housing includes at least one plating-reduction structure to prevent electrical shorting of the apparatus caused by plating of the liquid metal.

20 Claims, 6 Drawing Sheets

REDUCED PLATING IGNITRON

FEDERAL RESEARCH STATEMENT

The invention described herein was made by employees of the United States Government and may be manufactured and used by or for the Government of the United States of America for governmental purposes without the payment of any royalties thereon or therefore.

CROSS-REFERENCES TO RELATED APPLICATIONS

None.

FIELD OF INVENTION

The present invention relates to switches, and specifically to an ignitron using non-hazardous liquid metal.

TERMINOLOGY

As used herein, the term "anode" refers to a positively charged conductive surface.

As used herein, the term "cathode" refers to a negatively charged conductive surface.

As used herein, the term "ignitor arc" refers to the current generated between an ignitor electrode and a cathode which vaporizes a small amount of cathode.

As used herein, the term "ignitor electrode" refers to a small anode which emits a current between itself and the cathode, forming an ignitor arc.

As used herein, the term "ignitron" refers to a switch using a vaporized liquid metal to complete a conducting path between a cathode and an anode.

As used herein, the terms "non-hazardous" and "non-toxic" mean metals which do not form poisonous soluble compounds or do not harm a living organism through physical contact or other handling.

As used herein, the terms "plating out" and "plate out" refer to the undesirable process of a conductive material recondensing on an insulating surface to create an alternative path between a cathode and an anode for current to flow.

As used herein, the term "plating-reduction structure" refers to any structure, material or device used to prevent or slow the plating of a conductive substance on an insulating surface. Plating-reduction structures may include, but are not limited to, baffles, phobic strips, insulating material, heaters, coolers and combinations thereof.

As used herein, the term "primary arc" refers to the current generated between a cathode and anode which closes an ignitron and allows current to flow.

BACKGROUND OF THE INVENTION

Ignitrons are high current switches that can open and close very quickly by using plasma (vaporized metal) arcs to complete the circuit. Typically the metal used is mercury because mercury does not readily plate on the inner surface of the ignitron. However, mercury is considered a hazardous and toxic substance, and attempts in the art to use non-hazardous metals, such as gallium, have not been successful because of the propensity for these metals to plate out and complete a circuit between an anode and a cathode.

Plating out is an undesirable occurrence which, once a continuous path of solidified conductive material, such as gallium, is formed along the inside surface of an ignitron's housing, shorts or permanently closes the switch, rendering the switch inoperable.

Ignitrons typically include a liquid metal cathode and an anode separated by a distance in a vacuum chamber. As current moves through an ignitor electrode, a small ignitor arc is formed between the ignitor electrode and the liquid metal surface forming the cathode, resulting in the vaporization of a quantity of the liquid metal. As the quantity of vaporized liquid metal increases, and if the potential difference between the cathode and anode is above a threshold level, the vaporized liquid metal completes the main circuit and a primary plasma arc is formed between the cathode and the anode, closing the ignitron switch and allowing current to flow.

Ignitrons are capable of conducting high currents, allowing for fast discharge of capacitors and providing high instantaneous power over a very short time. Ignitrons have been commonly used in pulsed lasers, pulsed fusion and power rectification. These and other pulsed power systems used by NASA require ignitrons because they are capable of conducting high currents and holding off high voltages. Typical switches are not practical for high current/high voltage pulsed systems because the switches cannot turn on or off quickly enough or conduct enough current.

One exemplary use for ignitrons is in present terrestrial power delivery systems. For example, solar storms may disrupt the Earth's magnetic fields, causing geomagnetically induced current to be produced in power lines. To prevent damage to electrical transmission equipment, capacitors may be used at the neutral-to-ground junctures. However, it is necessary to provide a way to quickly bypass the capacitor in the event of an actual fault to allow large current to flow from the neutral to the ground. Ignitrons may be useful in this application because they close more quickly than a mechanical switch and have the ability to handle high currents repetitively.

Ignitrons form a relatively short-lived electrical connection between two electrodes through a plasma arc composed of vaporized liquid mercury. Ignitions known in the art generally use mercury because it is a liquid at room temperature and perhaps more importantly, it does not rapidly plate out, or condense and form a solidified surface on the inside insulating surface of an ignitron's housing.

The main disadvantage with using mercury in ignitrons is its hazardous nature. The ignitron may not be cleaned (for example, when the mercury plates out) or otherwise serviced because mercury cannot be easily handled. Further, mercury-filled ignitrons must be specially disposed of, resulting in additional disposal costs.

There is an unmet need for ignitrons which are structurally adapted to use gallium, gallium alloys and other non-hazardous, non-toxic liquid metal in place of mercury, resulting in switches that are easier to handle, serviceable and reusable. Gallium and gallium alloy switches are also easier to dispose of, resulting in lower disposal costs.

There is also an unmet need for a gallium-based ignitron because gallium-based ignitrons hold off significantly higher voltages than mercury-based ignitrons due to the much lower vapor pressure of gallium. Gallium and gallium alloys are therefore ideal replacements for mercury in ignitrons.

U.S. Pat. Nos. 3,462,573, 5,478,978 and 5,792,236 teach switches where gallium was used in place of mercury. However, these switches use liquid gallium to complete or interrupt a circuit without vaporizing the gallium and forming a plasma. These switches, therefore, are not useful for high voltage and/or high current switching. The switches disclosed in these patents also do not consider vaporizing and ionizing the liquid gallium, with the current only traveling across a purely liquid conductive path.

Even if the gallium was vaporized in the switches described in U.S. Pat. Nos. 3,462,573, 5,478,978 and 5,792,236, the switches would be impractical because gallium and gallium alloys have a high disposition for plating out.

Gallium and gallium alloys plate out more readily than mercury, rendering switches that rely on vaporizing gallium or gallium alloys inoperable over a short period of time. Ignitrons using gallium and gallium alloys would therefore have a significantly shorter life span than the mercury-based ignitrons.

SUMMARY OF THE INVENTION

The present invention is an ignitron apparatus with an airtight tubular housing having a first sealed end and a second sealed end. An anode is connected at the first sealed end, projecting into the housing, and a recess at the second sealed end forms a well which contains a quantity of liquid gallium or gallium alloy making up the cathode. An ignitor projects through the liquid metal and into the housing. The inner surface of the housing includes at least one plating-reduction structure to prevent plating of the liquid metal.

DETAILED DESCRIPTION

Figure 1:
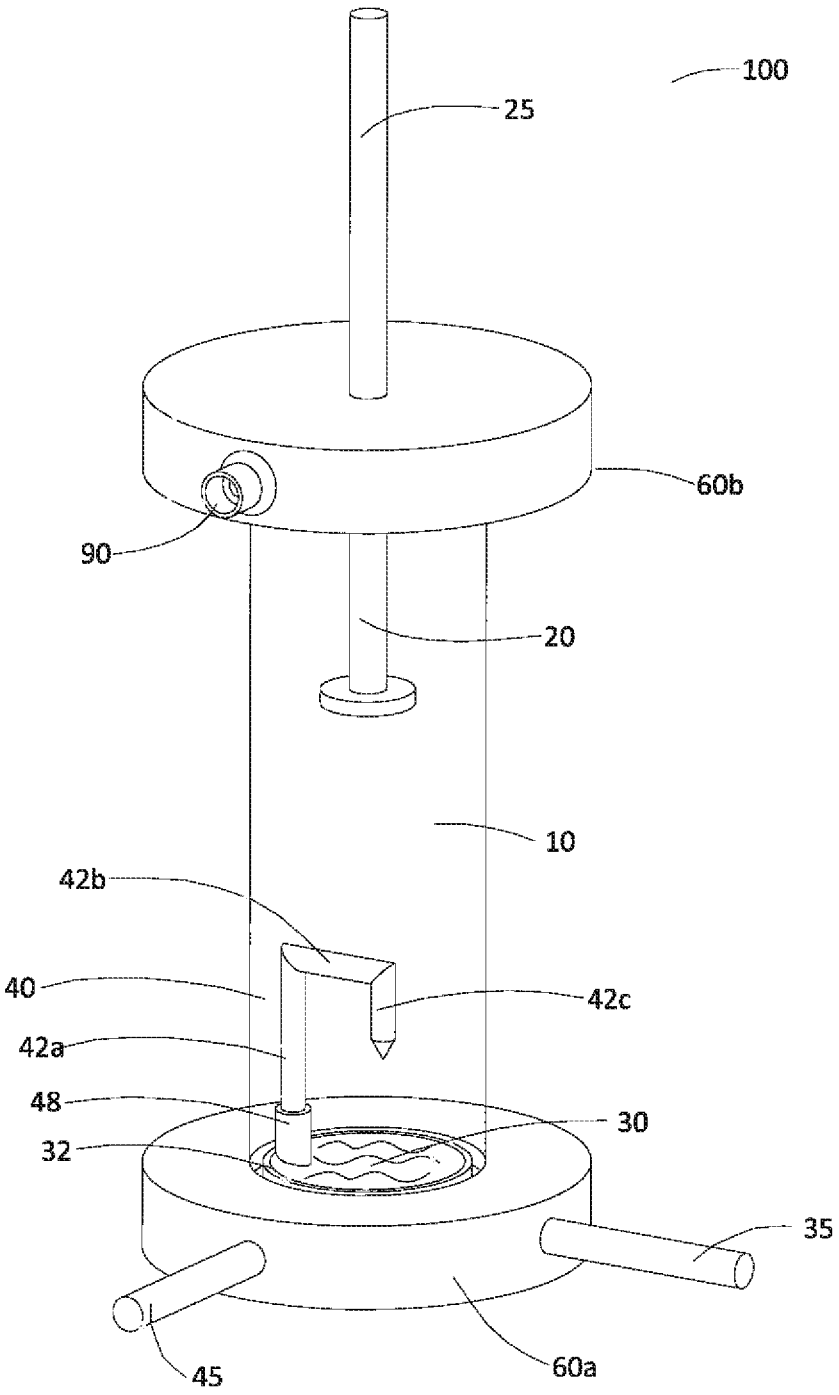
FIG. 1 is an exemplary embodiment of a high-current high-voltage switch using non-hazardous liquid metal.

For the purpose of promoting an understanding of the present invention, references are made in the text to exemplary embodiments of a high-current, high-voltage switch using non-hazardous liquid metals, only some of which are described herein. It should be understood that no limitations on the scope of the invention are intended by describing these exemplary embodiments. One of ordinary skill in the art will readily appreciate that alternate but functionally equivalent materials, components, and steps may be used. The inclusion of additional elements may be deemed readily apparent and obvious to one of ordinary skill in the art. Specific elements disclosed herein are not to be interpreted as limiting, but rather as a basis for the claims and as a representative basis for teaching one of ordinary skill in the art to employ the present invention.

It should be understood that the drawings are not necessarily to scale; instead, emphasis has been placed upon illustrating the principles of the invention. In addition, in the embodiments depicted herein, like reference numerals in the various drawings refer to identical or near identical structural elements.

Moreover, the terms "substantially" or "approximately" as used herein may be applied to modify any quantitative representation that could permissibly vary without resulting in a change in the basic function to which it is related.

FIG. 1 is an exemplary embodiment of a high-current, high-voltage switch using a non-hazardous liquid metal 100. Vacuum vessel 10 with end caps 60*a*, 60*b* contains anode 20 and cathode 30 at opposite ends. Ignitor electrode 40 projects through cathode 30 and turns back to point towards cathode 30. Also illustrated in FIG. 1 is insulating sleeve 48 around ignitor 40. In the exemplary embodiment shown, insulating sleeve 48 is an electrically-insulating sleeve which shields ignitor 40 from cathode 30 as it passes through cathode 30.

As illustrated in FIG. 1, anode 20 includes anode lead 25, which connects anode 20 to the remainder of a circuit. Anode lead 25 can be implemented to allow anode 20 to be moved and repositioned vertically in vacuum vessel 10. Similarly, cathode 30 includes cathode lead 35, which connects cathode 30 to the remainder of a circuit, and ignitor electrode 40 includes ignitor lead 45, which connects ignitor 40 with a current source.

in the exemplary embodiment shown, cathode 30 is a conductive surface created by liquid metal contained in liquid metal well 32. In the exemplary embodiment described in FIG. 1, liquid metal well 32 contains liquid gallium which creates cathode 30. However, in further exemplary embodiments, liquid metal well 32 may contain any non-hazardous or non-toxic liquid metal, including gallium alloys and combinations of gallium and gallium alloys, or any other metal which is a liquid at or near room temperature.

Gallium and gallium alloys have a lower vapor pressure than mercury, and may therefore hold off significantly more voltage than mercury-based ignitrons because higher vacuum levels can be achieved in the case of the former. The lower electrical resistance of gallium and gallium alloys also makes gallium and gallium alloys up to twenty times more conductive than mercury, allowing for smaller electrodes and more current flow without concern for overheating.

Gallium and gallium alloys also have a lower density, with gallium being approximately half as dense as mercury. Gallium and gallium alloys therefore offer significant weight advantages.

In some exemplary embodiments, liquid metal well 32 may contain a gallium alloy comprised of 62.5% gallium, 21.5% indium and 16% tin. This alloy has a melting point of approximately 10° C. with a vapor pressure of $10^{-8}$ torr at 600° C. By adding additional elements, such as lithium, sodium, rubidium, silver, antimony, gold, platinum, cesium and bismuth, the melting point of a gallium alloy may be reduced to almost 0° C.

In further exemplary embodiments, liquid metal well 32 may contain any metal or combinations of metals which are specifically chosen to be liquid in a specific workable range. For example, it is ideal for a metal to remain liquid over the range of temperatures the specific ignitron will experience, and the specific metal or combination of metals may be chosen based on that temperature range. Having a metal which is liquid down to 0° C. will make the ignitron operable in most environments. However, if an environment experiences a temperature below the freezing temperature of the metal, the ignitron will need to be heated by an external source. Most liquid metals are liquid over hundreds of degrees (i.e., gallium is liquid from 29.8° C. to 2,204° C.).

Using a non-hazardous liquid metal, such as gallium, allows high-current, high-voltage ignitron 100 to be opened and repaired without danger.

In the exemplary embodiment shown in FIG. 1, ignitor 40 passes through cathode 30 and completes a 180° turn to point towards cathode 30, but the tip does not come in physical contact with cathode 30. In the exemplary embodiment shown, ignitor 40 includes sleeve 48, which in the exemplary embodiment described is alumina tubing. In further exemplary embodiments, sleeve 48 may be of any other insulating material to isolate the base of ignitor 40 from cathode 30. In still further exemplary embodiments, ignitor 40 may include any other structure or coating which prevents ignitor 40 from being in physical contact with cathode 30.

As illustrated, ignitor 40 is a U-shaped structure made of three sections 42*a*, 42*b*, 42*c*, with section 42*a* protruding through cathode 30, section 42*b* turning parallel to cathode 30, and section 42*c* turning back towards and perpendicular to cathode 30, with each of the turns occurring at a 90° angle. As illustrated in FIG. 1, section 42*c* of ignitor 40 is pointed to enhance the electric field when switch 100 is in use, reducing the surface area in contact with the plasma, which increases the ohmic heating and commensurate metal vaporization.

In further exemplary embodiments, ignitor 40 may be a single piece, and ignitor 40 may turn more gradually towards cathode, creating a curved U-shape. In further exemplary embodiments, ignitor 40 may be configured to enter switch 100 through vacuum vessel 10 wall and bend appropriately, such as 90°, to face cathode 30. In still further exemplary embodiments, ignitor 40 may bend at sharp, distinct angles, while in yet further exemplary embodiments, ignitor 40 may contain curved, smooth bends. Ignitor 40 may or may not be pointed.

In the exemplary embodiment shown, vacuum vessel 10 is a Pyrex tube having a 2.5 inch outer diameter, 12 inch length and 4.8 mm thickness. However, in further exemplary embodiments, vacuum vessel 10 may be any electrically-insulating material and dimensions capable of housing anode 20, cathode 30 and ignitor 40 and maintaining a vacuum. In still further exemplary embodiments, the dimensions of vacuum vessel 10 may be specifically calculated to optimize switch 100 performance at a given voltage holdoff or electrode diameter, which is a function of the current density at the electrodes).

In the exemplary embodiment described, vacuum vessel 10 may be evacuated, using valve 90. However, in further exemplary embodiments, vacuum vessel 10 may be only partially evacuated to the millitorr range. The level of vacuum required can vary depending on the specific application, specifically relating to the desired voltage holdoff. As illustrated, valve 90 is a standard valve known in the art to which a vacuum pump may be connected. In further exemplary embodiment, vacuum vessel 10 may be evacuated using any method or device known in the art.

End caps 60*a*, 60*b* are polyethylene, or another appropriate insulator compatible with the gallium vapor environment, and form air-tight seals at the ends of vacuum vessel 10. In the exemplary embodiment described, end caps 60*a*, 60*b* are removable from vacuum vessel 10 to allow switch 100 to be cleaned or otherwise serviced.

In the exemplary embodiment described, electrodes 20 and 40, as well as leads 25, 35 and 45, are stainless steel. Anode 20 is a stainless steel disk with a 1 inch diameter and ¼ inch thickness welded to anode lead 25, which is a stainless steel rod having a ¼ inch diameter and 13 inch length. This construction of anode 20 allows anode 20 to be easily replaced in case of erosion. Anode 20 may also be configured with different geometries. Cathode lead 35 is a ¼ inch stainless steel rod submerged in liquid metal well 32 to be in contact with cathode 30, which is liquid metal.

In further exemplary embodiments, electrodes 20 and 40 and leads 25, 35 and 45 may be of different materials and dimensions. In still further exemplary embodiments, the materials and dimensions of electrodes 20 and 40 and leads 25, 35 and 45 may be specifically chosen for a specific ignitron application or voltage holdoff. In some exemplary embodiments, electrodes 20 and 40 and leads 25, 35 and 45 may even be different material from each other.

For example, in the embodiment described in FIG. 1, stainless steel was chosen for electrodes 20 and 40 and leads 25, 35 and 45 because of its availability and known compatibility with gallium and gallium alloys, which are the preferred liquid metals used in this embodiment. Copper, on the other hand, is not as compatible with gallium and gallium alloys and would not be chosen as an electrode or lead material. In further exemplary embodiments, the material of electrodes 20 and 40 and leads 25, 35 and 45 may be specifically chosen based on a material's compatibility with the specific liquid metal being used.

Other materials with known compatibility to other liquid metals which may be used include, but are not limited to, graphite, molybdenum and titanium and combinations of these metals.

Figure 2A:
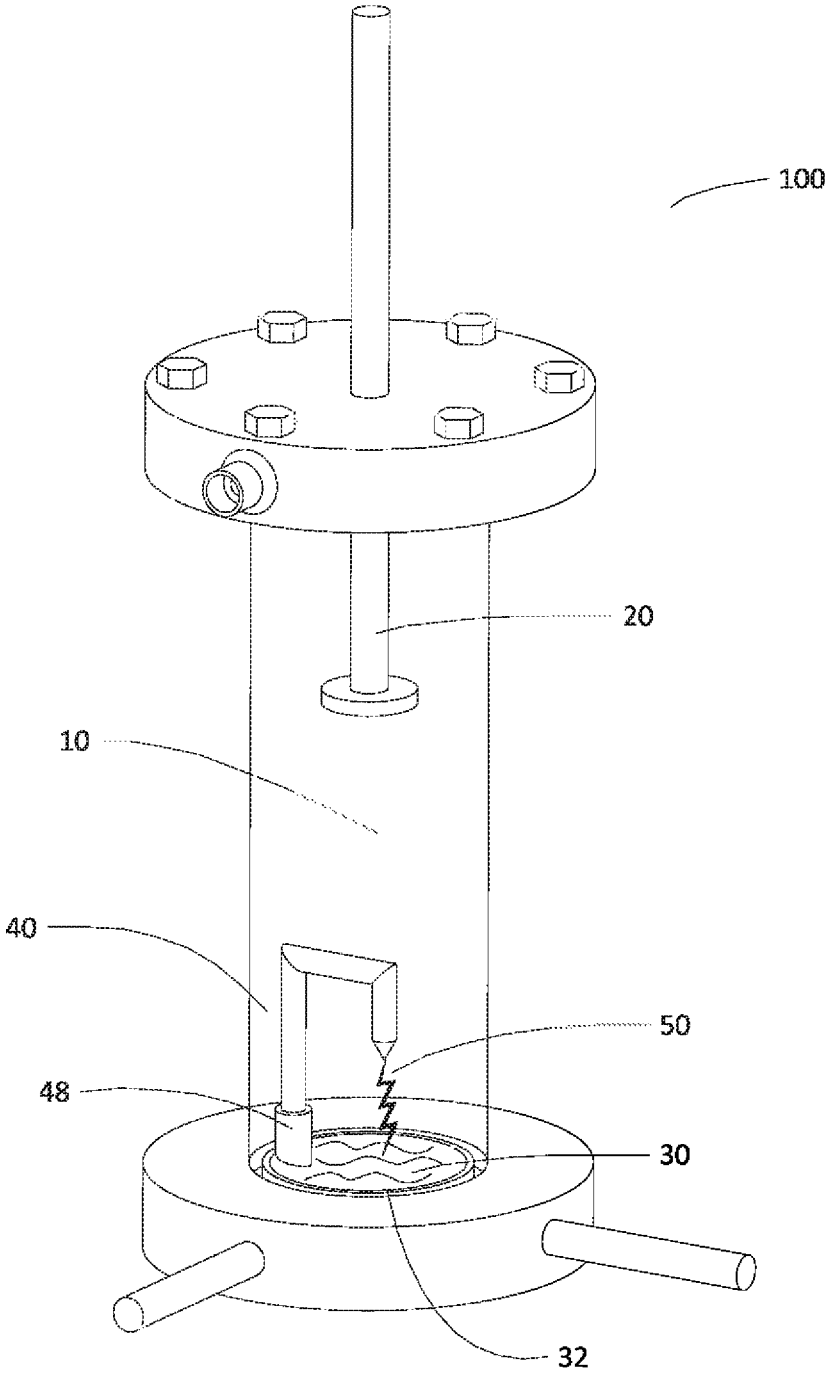
FIG. 2*a* is an exemplary embodiment of a high-current high-voltage switch using non-hazardous liquid metal producing an ignitor arc.

FIG. 2*a* illustrates an exemplary high-current, high-voltage switch using a non-hazardous liquid metal 100 in use with ignitor arc 50 created between ignitor 40 and cathode 30. Ignitor 40 sends a current pulse through cathode 30, causing the liquid metal in liquid metal well 32 to vaporize through ohmic heating. The vaporized liquid metal creates the small ignitor arc 50, which, in essence, primes switch 100 for creating primary arc 55 (not shown) between anode 20 and cathode 30 by continuing to vaporize the liquid metal at cathode 30.

In the exemplary embodiment described, ignitor 40 provides a 2 kV pulse of approximately 1-10 microseconds to vaporize liquid metal from liquid metal well 32 and form ignitor arc 50. In further exemplary embodiments, ignitor 40 may provide a different voltage or pulse duration to vaporize the liquid metal. For example, a pulse may be fast (i.e., on an order of 1-10 microseconds) or of longer duration (i.e., on an order of 100 microseconds to milliseconds). In still further exemplary embodiments, the pulse voltage and duration may be dependent on the voltage and current waveform of the discharge. In most exemplary embodiments, however, the pulse duration and voltage will not require modification based on cathode 40 material.

Figure 2B:
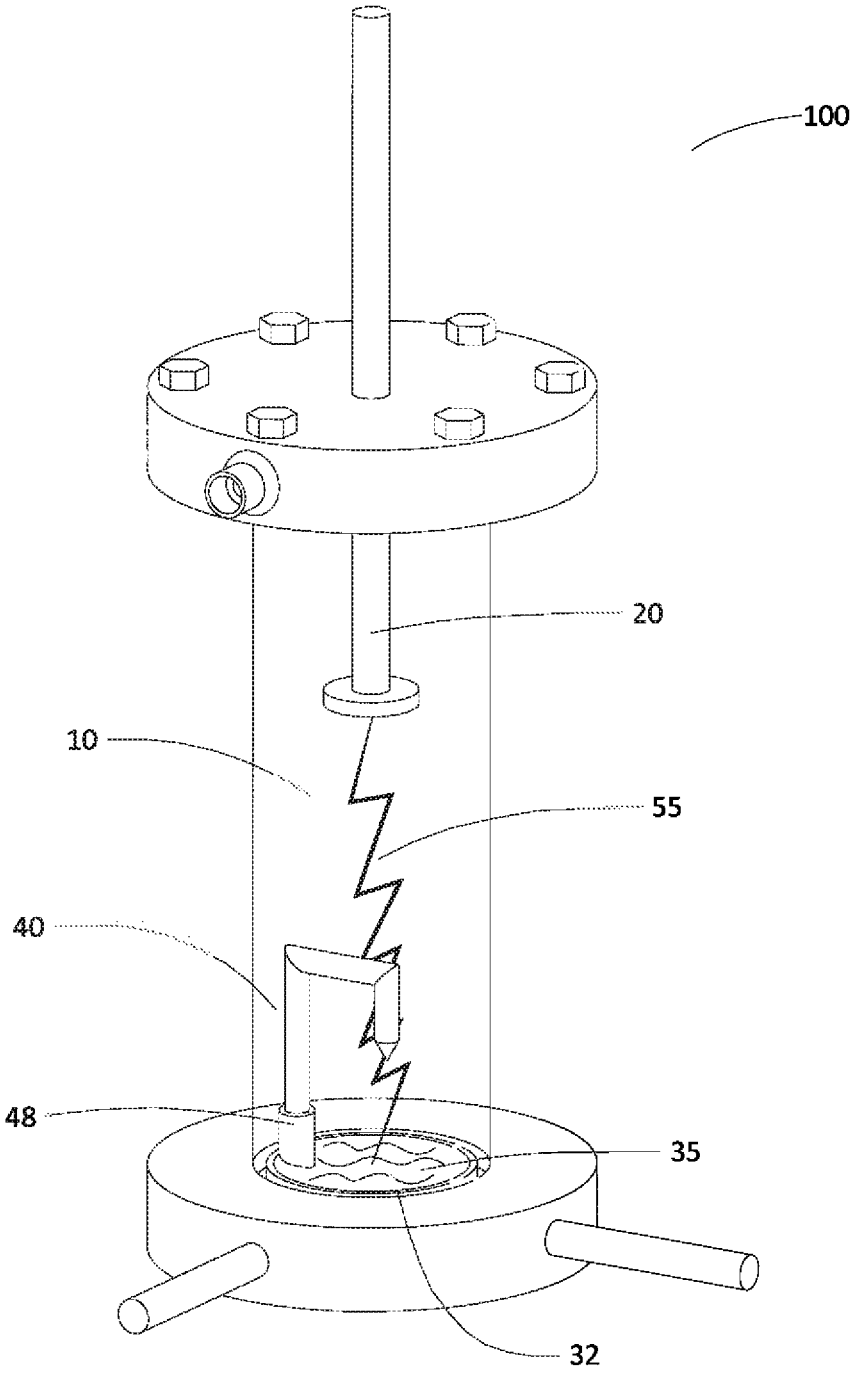
FIG. 2*b* is an exemplary embodiment of a high-current high-voltage switch using non-hazardous liquid metal producing a primary arc.

Once the ionized vapor bridges the gap between anode 20 and cathode 30, creating a conduction path, primary arc 55 is formed, as illustrated in FIG. 2*b*. Cathode 30 serves as a source of electrons for maintaining primary arc 55. Primary arc 55 will continue to exist until the capacitor to which switch 100 is connected has discharged to a level where the voltage between anode 20 and cathode 30 is below the voltage threshold for a self-sustaining arc discharge.

In the exemplary embodiment shown in FIGS. 2*a* and 2*b*, ignitor arc 50 and primary arc 55 are plasma arc discharges.

Figure 3A:
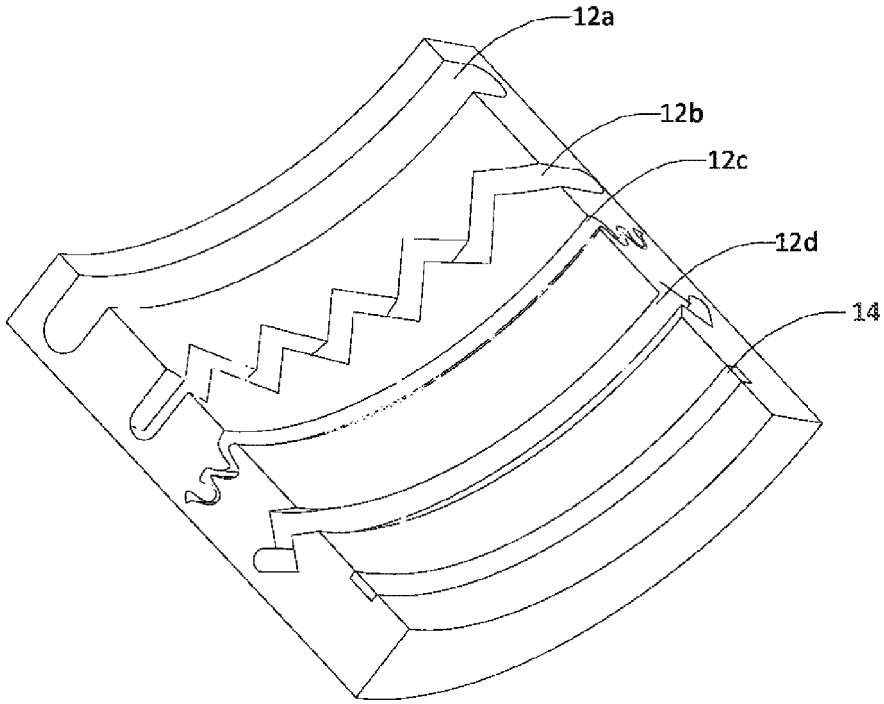
FIGS. 3*a* and 3*b* illustrate exemplary plating-reduction structures.
Figure 3B:
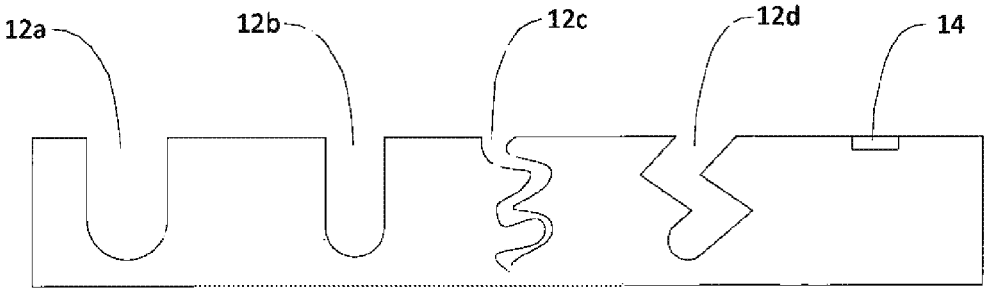

FIGS. 3*a* and 3*b* illustrate the inside surface of vacuum vessel 10. One problem known in the art with existing mercury-based ignitrons is that the liquid metal eventually plates the interior walls of the ignitron and shorts the electrodes. This plating out is a significantly greater problem when using gallium, gallium alloys and other non-hazardous metals because these metals have a higher tendency to condense and plate on the inside surface of an ignitron's housing. To over-come that problem of the prior art, the inside surface of vacuum vessel 10 contains plating-reduction structures 12*a*, 12*b*, 12*c*, 12*d* and 14.

Exemplary baffles 12*a*, 12*b*, 12*c* and 12*d* represent only a few possible baffle configurations. Baffles 12*a* and 12*b* are straight baffles cut into the inside of vacuum vessel 10 wall and continuing around the entire circumference of vacuum vessel 10. As illustrated in FIGS. 3*a* and 3*b*, baffle 12*a* is a simple straight baffle which is a straight groove cut into vacuum vessel 10, whereas baffle 12*b* is a more complicated straight baffle which is a straight groove cut in a rickrack pattern around vacuum vessel 10.

Baffles 12*c* and 12*d* are complicated baffles which are not simple grooves cut into vacuum vessel 10. In the exemplary embodiment shown in FIGS. 3*a* and 3*b*, baffle 12*c* creates a torturous path inward from the inner surface of vacuum vessel 10. From the inner surface of vacuum vessel 10, baffle 12*c* appears to be a simple groove cut around the circumference of vacuum vessel 10. However, when viewed at the cross section as illustrated in FIG. 3*b*, baffle 12*c* creates a complicated, torturous path into the wall of vacuum vessel 10. Baffle 12*c* does not permit a continual line of sight from the interior of vacuum vessel 10 to the end of baffle 12*c*, making it significantly harder for liquid metal to plate onto the inner surface of vacuum vessel 10 and electrically short circuit switch 100.

Similarly, baffle 12*d* does not permit a continual line of sight from the interior of vacuum vessel 10 to the end of baffle 12*d*; however, baffle 12*d* is not as complicated, and therefore may not be as good at preventing plating as baffle 12*c*, though it may be significantly easier to manufacture.

While in the exemplary embodiment shown, vacuum vessel 10 contains four different baffles 12*a*, 12*b*, 12*c*, and 12*d*, alternative embodiments may use more or fewer baffles, and baffles may be of the same or differing designs. In still further exemplary embodiments, additional baffle configurations or combinations of baffle configurations may be used on the inside surface of vacuum vessel 10.

In some embodiments, baffles may cover all or portions of the inside surface of vacuum vessel 10. In still further exemplary embodiments, baffles may be cooled to condense the metal vapor before it enters the entire baffle gap or heated to discourage condensing on those surfaces and prevent plating.

Also illustrated in FIGS. 3*a* and 3*b* is phobic strip 14. Phobic strip 14 is a ring of material around the circumference of vacuum vessel 10 which helps prevent plating. In the exemplary embodiment shown, phobic strip 14 is made of a material to which gallium and gallium alloys do not readily adhere or plate. In some exemplary embodiments, phobic strip 14 may be a specific substance chemically phobic to gallium and gallium alloys. In further exemplary embodiments, when the liquid metal used is not gallium or gallium alloys, the material of phobic strip 14 may be specifically selected to not allow the adherence or plating of those liquid metals.

In yet further exemplary embodiments, phobic strip 14 may be an insulating material which through active cooling or heating is kept at a temperature that is cooler or warmer than the surrounding surfaces, thereby preventing plating.

While in the exemplary embodiment shown, vacuum vessel 10 contains a single phobic strip 4, in further exemplary embodiments, vacuum vessel 10 may contain any number of phobic strips 14, with or without baffles, and phobic strips 14 may be of any dimensions. In yet further exemplary embodiments, vacuum vessel 10 may contain phobic strips 14 having different porosities to alter the surface tension properties of the liquid metal on vacuum vessel 10 walls, which in the exemplary embodiment shown are ceramic.

In still further exemplary embodiments, the inside surface of vacuum vessel 10 may be actively heated or cooled, with or without the presence of baffles or phobic strips, to keep the liquid metal from plating the walls and shorting electrodes 20, 30 (not shown).

In the exemplary embodiments illustrated, baffles, phobic strips, insulating surfaces, areas of heating or cooling and other plating-reduction structures may be placed anywhere on vacuum vessel 10. However, in further exemplary embodiments, baffles may be strategically placed on vacuum vessel 10. For example, placing a baffle behind anode 20 would shield the baffle (i.e., it would not be directly exposed to an arc discharge) while still allowing the baffle to interrupt any direct conductive plated path between cathode 30 and anode 20. Baffles, phobic strips, insulating materials and other plating-reduction structures may also be placed in areas easily reached for cleaning.

In some exemplary embodiments, multiple types of plating-reduction structures may be included on a single vacuum vessel 10. However, in further exemplary embodiments, vacuum vessel 10 may contain a single type of plating-reduction structure or limited mix of plating-reduction structures.

Figure 4:
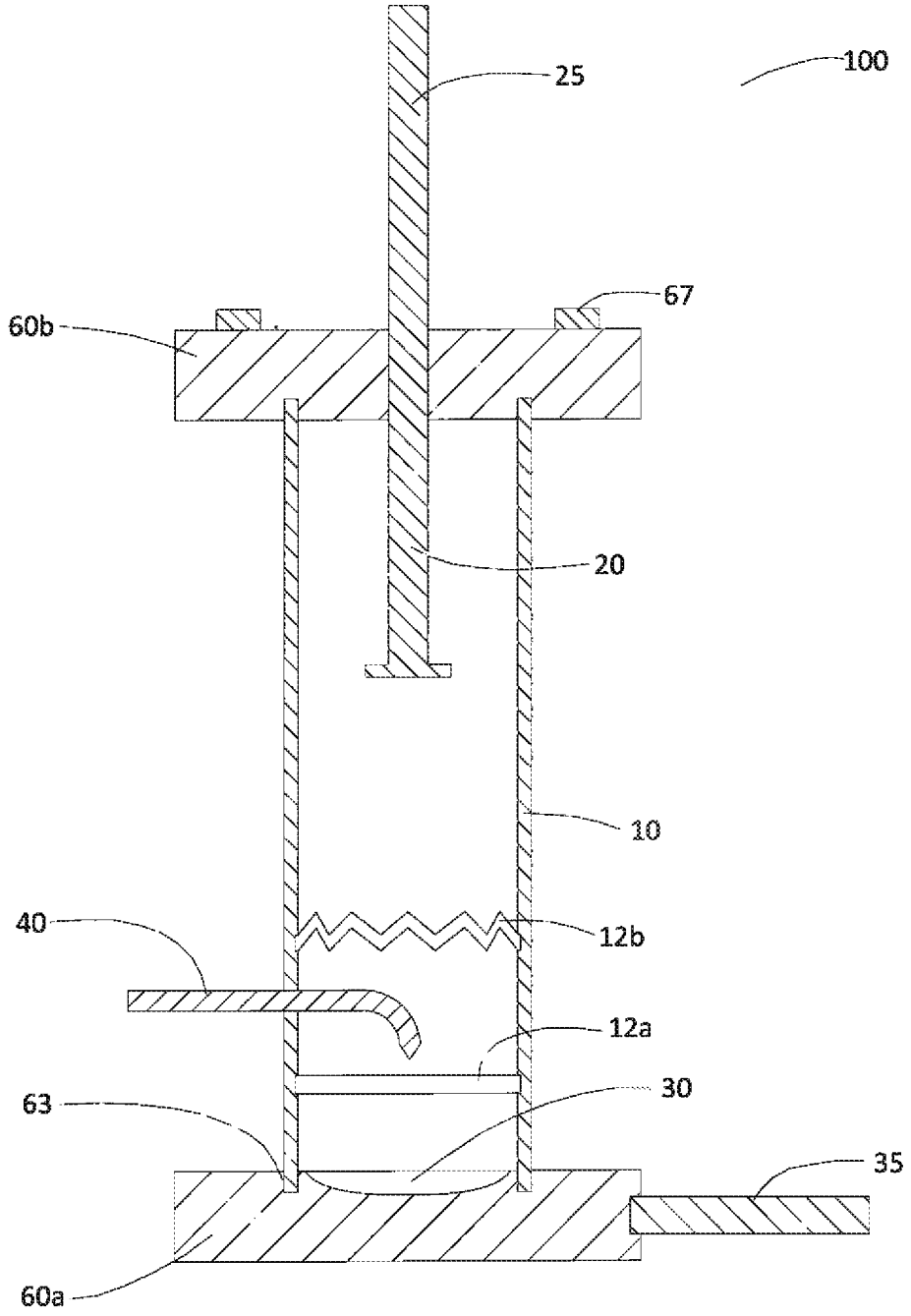
FIG. 4 illustrates an alternative exemplary embodiment of an exemplary embodiment of a high-current high-voltage switch using non-hazardous liquid metal.

FIG. 4 is an alternative embodiment of high-current, high-voltage switch using non-hazardous metals 100. In the exemplary embodiment shown, switch 100 includes temperature control connector 70, which is used to connect switch 100 to a heating or cooling device to warm or cool vacuum vessel 10 so that the liquid metal does not plate.

In further exemplary embodiments, high-current, high-voltage switch 100 may incorporate additional or different heating elements to prevent liquid metal from solidifying or condensing on vacuum vessel 10 and other components of high-current, high-voltage switch 100.

As illustrated, ignitor 40 is a single curved structure with a pointed tip projecting through vacuum vessel 10. Ignitor lead 45 may bend downward to meet lead 35 or may project straight outward from vacuum vessel 10. Plating-reduction structures 12*a*, 12*b* are present between anode 20, cathode 30 and ignitor 40, which in the exemplary embodiment shown are baffles. In further exemplary embodiments, plating-reduction structures 12*a*, 12*b* may be insulating or phobic materials or a heating or cooling area.

FIG. 4 also shows end caps 60*a* and 60*b* in more detail. In the exemplary embodiment shown, end cap 60*a* is a single unit containing holes 65 (not shown) through which temperature control connector 70 and leads 35 and 45 pass. End cap 60*a* contains groove seal 63 which secures end cap 60*a* to vacuum vessel 10 and forms and air tight seal. End cap 60*a* may be permanently or releasably secured to vacuum vessel 10.

End cap 60*b* includes valve 90 for evacuating vacuum vessel 10. A plurality of bolts 67 help tighten and secure end cap 60*b* on vacuum vessel 10 to create an air tight, resealable seal.

Figure 5A:
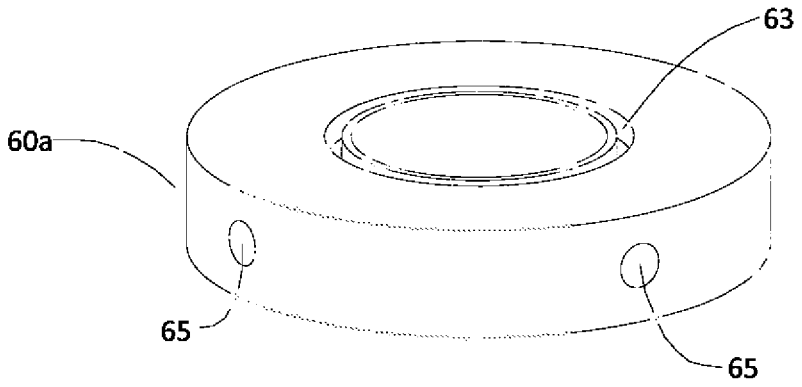
FIGS. 5*a* and 5*b* illustrate exemplary end caps for a high-current high-voltage switch using non-hazardous liquid metal.
Figure 5B:
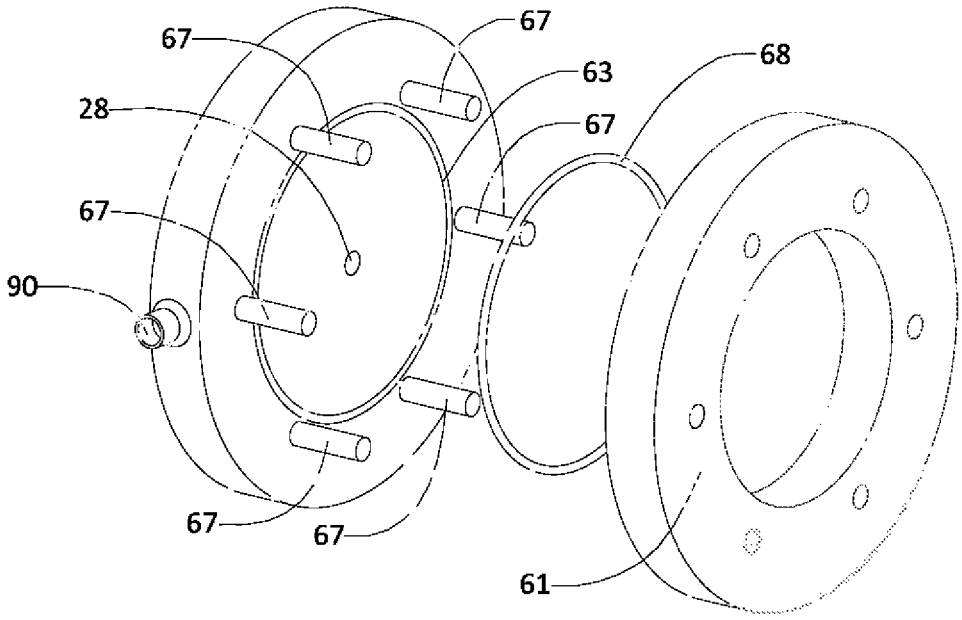

FIGS. 5*a* and 5*b* illustrate exemplary end caps 60*a* and 60*b* for switch 100 in more detail. In FIG. 5*a*, groove seal 63 and holes 65 for leads 35 and 45 are visible. In further exemplary embodiments, end cap 60*a* may contain additional holes for additional leads or other components of switch 100, including, but not limited to, temperature control components.

In some exemplary embodiments, groove seal 63 may contain additional sealing and securing components, including gaskets, deformable materials, latches and other structures and devices which help create an airtight seal at groove seal 63. In further exemplary embodiments, end cap 60*a* may secure to vacuum vessel 10 (not shown) using any structure or device known in the art, and end cap 60*a* may be any shape, structure or configuration known in the art to create a seal on the end of vacuum vessel 10 (not shown).

As illustrated in FIG. 5*a*, end cap 60*a* is a single polyethylene disk 6 inches in diameter and 1 inch thick, with holes 65 for electrodes. Groove seal 63 is machined into bottom end cap 60*a* to receive and secure vacuum vessel 10.

FIG. 5*b* illustrates end cap 60*b*. In the exemplary embodiment shown, end cap 60*b* is created from two polyethylene disks 5 inches in diameter, with lower piece 61 0.5 inches thick and upper piece 62 1 inch thick. Lower piece 61 is bored to the diameter of vacuum vessel 10 and sealed directly to vacuum vessel. Lower piece 61 and upper piece 62 are connected using 6 bolts 67, with a vacuum seal between formed by o-ring 68 (not shown). Upper piece 62 contains lip 64, which in the exemplary embodiment shown is machined, to secure vacuum vessel 10. Upper piece 62 also contains anode lead aperture 28 for anode lead 25 (not shown).

In some exemplary embodiments, anode lead 25 (not shown) may be slidable in said anode lead aperture 28 to permit the distance between cathode 30 and anode 20 to be adjustable. In still further exemplary embodiments, the distance between cathode 30 and anode 20 may be varied using any structure or device known in the art.

The two piece construction (e.g., lower piece 61 and upper piece 62) permits access to vacuum vessel 10 to remove contaminated gallium, clean vacuum vessel 10 (not shown) walls and any baffles of plating mitigation features, and to change anodes. Upper piece 62 may be unbolted from lower piece 61, and the interior components of switch 100 (not shown) serviced.

In further exemplary embodiments, end caps 60*a* and 60*b* may be any structure or device known in the art to provide airtight seals and the ends of vacuum vessel 10 (not shown). Allowing access to the interior of vacuum vessel 10 (not shown) is desirable for the purpose of servicing the device.

What is claimed is:

1. A reduced plating ignitron apparatus comprising:

an airtight tubular housing having an inner surface, a first sealed end and a second sealed end, wherein said tubular housing contains at least one plating-reduction structure;

an anode connected at said first sealed end and projecting into said housing;

a recess at said second sealed end configured to hold a quantity of liquid metal, wherein said quantity of liquid metal forms a cathode surface;

a cathode lead connected at said second sealed end and projecting into said recess; and an ignitor electrode projecting into said housing and pointing towards said liquid metal, wherein said liquid metal is a non-hazardous metal.

2. The apparatus of claim 1 wherein said plating reduction structure is selected from the group consisting of a baffle, a phobic strip, an insulating material, a heater, a cooler and combinations thereof.

3. The apparatus of claim 1 wherein said plating reduction structure is a baffle.

4. The apparatus of claim 3 wherein said baffle is a groove around the circumference of said inner surface of said tubular housing.

5. The apparatus of claim 4 wherein said groove does not provide a continuous line of sight from said inner surface of said tubular housing to the rear wall of said groove.

6. The apparatus of claim 1 wherein said plating reduction structure is a phobic strip.

7. The apparatus of claim 1 wherein said first sealed end is removable from said tubular housing.

8. The apparatus of claim 1 which includes a heater element.

9. The apparatus of claim 1 wherein said liquid metal is selected from the group consisting of gallium and gallium alloys.

10. The apparatus of claim 1 wherein said liquid metal is gallium.

11. The apparatus of claim 1 wherein said liquid metal is a gallium alloy.

12. The apparatus of claim 11 wherein said gallium alloy is comprised of 62.5% gallium, 21.5% indium and 16% tin.

13. The apparatus of claim 1 wherein said ignitor has a pointed end.

14. The apparatus of claim 1 wherein said anode includes an anode lead.

15. An ignitron apparatus comprising:

an airtight tubular housing having an inner surface, a first sealed end and a second sealed end, wherein said tubular housing contains at least one plating-reduction structure selected from the group consisting of a baffle, a phobic strip, an insulating material, a heater, a cooler and combinations thereof;

an anode connected at said first sealed end and projecting into said housing;

a recess at said second sealed end configured to hold a quantity of liquid metal, wherein said quantity of liquid metal forms a cathode surface;

a cathode lead connected at said second sealed end and projecting into said recess; and an ignitor electrode projecting into said housing and pointing towards said liquid metal, wherein said liquid metal is selected from the group consisting of gallium and a gallium alloy.

16. The apparatus of claim 15 wherein said plating-reduction structure is a baffle.

17. The apparatus of claim 16 wherein said baffle does not provide a continuous line of site from said inner surface of said tubular housing to the rear wall of said baffle.

18. The apparatus of claim 15 wherein said housing contains a vacuum.

19. The apparatus of claim 15 which includes at least two plating-reduction structures.

20. A method of closing an ignitron switch comprising the steps of:

sending a current pulse from an ignitor through a cathode, wherein said cathode is a quantity of liquid metal selected from the group consisting of gallium and gallium alloy;

vaporizing a portion of said liquid metal to form an ionized vapor;

generating an ignitor arc between said ignitor and said cathode with said vaporized and ionized liquid metal, wherein said ignitor arc is a plasma arc;

vaporizing additional liquid metal to form additional ionized vapor;

generating a primary arc between said cathode and an anode with said additional vaporized and ionized liquid metal, wherein said primary arc is a plasma arc which creates a conductive path between said cathode and said anode.

* * * * *